US006059670A

United States Patent [19]

Mogan

[11] Patent Number: 6,059,670

[45] **Date of Patent: *May 9, 2000**

[54] GOLF CLUB HAVING A HEAD WITH A HARD MULTILAYER STRIKING SURFACE AND METHOD FOR MAKING THE SAME

[76] Inventor: George D. Mogan, 11413 Swan Canvoa Rd., San Diego, Calif. 92131

[ * ] Notice: This patent issued on a continued prosecution application filed under 37 CFR 1.53(d), and is subject to the twenty year patent term provisions of 35 U.S.C. 154(a)(2).

[21] Appl. No.: 08/880,347

[22] Filed: Jun. 23, 1997

[51] Int. Cl.[7] ..... A63B 53/04

[52] U.S. Cl. ..... 473/342; 473/349

[58] Field of Search ..... 473/342, 324, 473/349

[56] References Cited

U.S. PATENT DOCUMENTS

| | | | |
|---|---|---|---|
| 1,854,548 | 4/1932 | Hunt . | |
| 3,218,072 | 11/1965 | Burr . | |
| 3,975,023 | 8/1976 | Inamori | 473/329 |
| 3,989,861 | 11/1976 | Rasmussen . | |
| 4,076,254 | 2/1978 | Nygren . | |
| 4,232,094 | 11/1980 | Rhodes | 428/614 |
| 4,413,825 | 11/1983 | Sasse . | |
| 4,534,558 | 8/1985 | Yonoyama . | |
| 4,544,341 | 10/1985 | Gnadig | 425/192 R |
| 4,618,149 | 10/1986 | Maxel . | |
| 4,630,826 | 12/1986 | Nishigaki . | |
| 4,749,197 | 6/1988 | Orlowski . | |
| 4,768,787 | 9/1988 | Shira | 473/331 |
| 4,809,978 | 3/1989 | Yamaguchi et al. . | |
| 5,154,425 | 10/1992 | Niskanen | 473/342 |
| 5,272,802 | 12/1993 | Stites | 29/527.2 |
| 5,354,056 | 10/1994 | Cornish | 473/317 |
| 5,364,571 | 11/1994 | O'Connor | 264/29.5 |
| 5,423,535 | 6/1995 | Shaw | 473/342 |
| 5,458,334 | 10/1995 | Sheldon | 473/349 |
| 5,516,107 | 5/1996 | Okumoto | 473/346 |
| 5,524,331 | 6/1996 | Pond | 473/342 |
| 5,620,382 | 4/1997 | Cho | 473/331 |
| 5,626,530 | 5/1997 | Schmidt | 473/331 |

FOREIGN PATENT DOCUMENTS

| | | |
|---|---|---|
| 52-26929 | 2/1977 | Japan . |

*Primary Examiner*—Jeanette Chapman
*Assistant Examiner*—Stephen L. Blau
*Attorney, Agent, or Firm*—David P. Gordon; David S. Jacobson; Thomas A. Gallagher

[57] ABSTRACT

The striking surface of a club head is provided with a multilayer coating. A first layer is a tungsten cobalt carbide matrix material which is applied to the substrate by thermal spraying. The particles of the tungsten cobalt carbide matrix material clump on the roughened surface, adhere to the surface by a mechanical bond, and provide a striking surface having a hardness of approximately 46 to 48 on the Rockwell C scale. Preferably, the club head is then heat treated in a vacuum at approximately 1850°F. for approximately five to ten minutes, causing the tungsten cobalt carbide matrix to fuse to the substrate in a metallurgical bond. The metallurgical bond provides a striking surface having a hardness of approximately 54 to 58. The striking surface is next treated to roughen the surface and to remove contaminants and impurities. A ceramic-metal matrix of hard composites is then thermal spray coated over the first layer, providing a striking surface with a hardness of approximately 60 to 63. Finally, any overspray on the club head is removed by sanding. The multilayer coating provides a very hard striking surface, has good adhesion to the substrate, and will not fracture after repeated impact between the club head and the golf ball. Other embodiments are also provided.

19 Claims, 2 Drawing Sheets

GOLF CLUB HAVING A HEAD WITH A HARD MULTILAYER STRIKING SURFACE AND METHOD FOR MAKING THE SAME

BACKGROUND OF THE INVENTION

1. Field of the Invention

This invention relates broadly to golf clubs. More particularly, this invention relates to golf club heads provided with a hardened striking surface.

2. State of the Art

A golf club, whether it is a driver, an iron, or a wedge, has a head that engages a golf ball when the golf club is swung at the golf ball. When a moving golf club strikes the ball, momentum is transferred from the club head to the ball. The force with which the ball is hit, and the resulting distance the ball travels is directly related to the hardness of the club head. This is because during the transfer of energy, momentum is conserved. The harder the club head surface, the less energy will be absorbed by the head itself and the greater the transfer of momentum to the ball.

Prior art FIGS. 1 and 2 show the club head 10 of a golf club 12. The head includes a striking surface 14 which, when the golf club is moved through a golfer's swing, makes the contact with a golf ball. The striking surface 14 is made of a substrate material 15 hard enough to transfer energy to the golf ball. The striking surface 14 is also typically provided with a plurality of horizontal grooves 16 which provide back-spin on the ball, and therefore a level of control between the striking surface 14 and the golf ball when the striking surface impacts against the golf ball.

The striking surface of a conventional golf club head has a hardness which is not ideal in that it does not transfer all of the momentum generated during the swing of the club head toward the ball. As a result, given a certain amount of momentum in the club head, maximum hitting distances are not obtained. This problem could be reduced if players could use a golf club having a club head provided with a harder striking surface; that is, a striking surface that could better translate the momentum of the swing into ball distance. However, providing a harder striking surface is only a partial solution to the problem, as either the entire head must made of the harder material, or the harder striking surface must be sufficiently bonded to the underlying club head material so as to avoid delamination of the striking surface from the underlying club head. Moreover, the striking surface must not be so brittle as to fracture upon impact with a golf ball and must have sufficient durability to be used over and over again.

SUMMARY OF THE INVENTION

It is therefore an object of the invention to provide a golf club head with a very hard striking surface.

It is another object of the invention to provide a coating on the striking surface of the club head of a golf club which is strongly bonded to the underlying substrate.

It is also an object of the invention to provide a club head substrate coating which will not fracture.

It is a further object of the invention to provide coatings on the substrate of a club head at the striking surface, the coatings being separately adapted for the club heads of drivers, wedges, and irons.

It is yet another object of the invention to provide a method of applying a very hard coating to the substrate of a golf club head to provide a very hard striking surface on the club head.

In accord with these objects which will be discussed in detail below, the striking surface of a club head is provided with a hard, multilayer coating. According to a preferred embodiment of the invention, a driver club head is first sandblasted or otherwise treated to remove contaminants and impurities from the substrate at the striking surface and to establish a roughened substrate at the striking surface. An undercoat of a tungsten cobalt carbide matrix material is thermally sprayed, either by flame spray or plasma spray, onto the substrate. The particles of the spray clump on the roughened surface, adhering to the surface by a mechanical bond, and provide a striking surface having a hardness of approximately 46 to 48 on the Rockwell C scale. Preferably (although not necessarily), the tungsten cobalt carbide matrix is then fused to the substrate in a metallurgical bond by heat treating in a vacuum at approximately 1850° F. for approximately five to ten minutes. The metallurgical bond provides a surface having a hardness of approximately 54 to 58 Rockwell C scale. If the club head is heat treated, the striking surface of the heat treated club head is preferably sandblasted or otherwise treated after the heat treatment to roughen the coated surface and to remove contaminants and impurities. The striking surface of the club heads are then thermal spray coated with a ceramic metal matrix of hard composites, providing a striking surface with a hardness of approximately 60 to 63 Rockwell C scale if the heat treatment step is performed, or slightly less if the heat treatment step is bypassed. Finally, any overspray on the club heads is removed in a polishing step.

The multilayer coating of the invention provides a very hard striking surface for contacting a golf ball and for transferring the momentum of a golfer's swing to the ball. The multilayer coating of the invention has very good adhesion to the substrate and will not fracture upon repeated impact with a golf ball.

According to other embodiments of the invention, the striking surface of a club head, preferably a wedge or iron club head, is treated to remove contaminants and impurities from the substrate at the striking surface and to establish a roughened substrate at the striking surface. An undercoat of a tungsten cobalt carbide matrix material is thermally sprayed onto the substrate, either by flame spraying or plasma spraying. Either a nickel aluminum and bronze matrix or a ceramic-metal matrix in a blend with the nickel aluminum and bronze matrix is thermally sprayed onto the striking surface of the club heads. The striking surface is finished by polishing. The multilayer coating obtained according to each embodiment is hard, has strong adhesion to the substrate, and does not fracture under the repeated impact between the striking surface of the club head and the golf ball.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
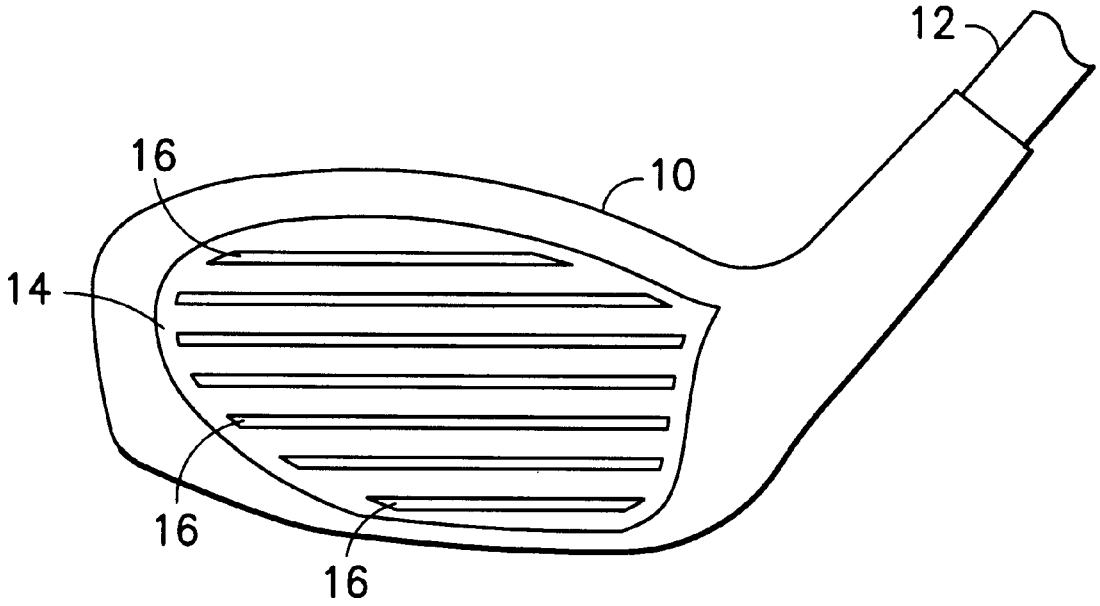
FIG. 1 PRIOR ART
FIG. 1 is a broken side elevation of a prior art club head portion of a golf club.
Figure 2:
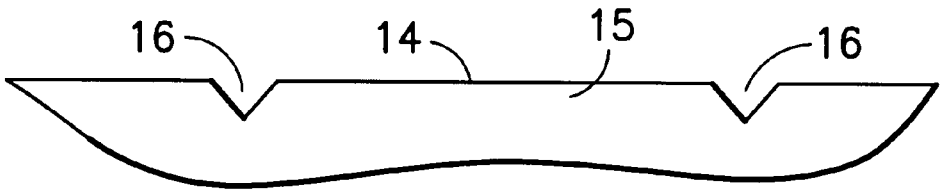
FIG. 2 PRIOR ART
FIG. 2 is an enlarged broken section through the prior art club head of FIG. 1 showing an uncoated striking surface.
Figure 3:
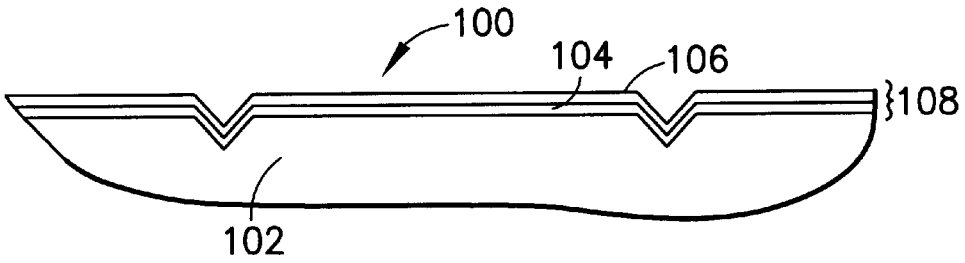
FIG. 3 is a view similar to FIG. 2 showing a multilayer coating according to a first embodiment of the invention.

Turning now to FIG. 3, and according to the invention, the striking surface 100 of a club head is preferably provided with a substrate material 102 of stainless steel, titanium, metallic composite, or carbide. According to the invention, the club head, especially in the region of the striking surface, is preferably sandblasted or otherwise treated to remove contaminants and impurities from the substrate and to establish a roughened substrate.

According to a first embodiment of the invention, which has preferable application to the striking surface of a driver club head, an undercoat of a tungsten cobalt carbide matrix material 104 is thermal sprayed, either by flame spray or plasma spray, onto the substrate 102. The tungsten cobalt carbide matrix material preferably contains, by atomic weight, approximately 38% tungsten, approximately 12% cobalt, approximately 0.5% carbon, approximately 1.5% silicon, approximately 6% chromium, approximately 1% boron, approximately 1.5% iron, approximately 7% aluminum, and approximately 32.5% nickel. The particulate size of the matrix material is preferably −170 mesh (+15 microns) and may be purchased premixed from Sulzer-Metco Inc. of Westbury, N.Y., or Miller Thermal Inc. of Baytown, Tex.

An alternate preferred undercoat matrix material contains, by atomic weight, approximately 38% tungsten, approximately 12% cobalt, approximately 0.5% carbon, approximately 1.5% silicon, approximately 6% chromium, approximately 1% boron, approximately 1.5% iron, and approximately 39.5% aluminum. Yet another preferred undercoat matrix material contains, by atomic weight, approximately 38% tungsten, approximately 12% cobalt, approximately 0.5% carbon, approximately 1.5% silicon, approximately 6% chromium, approximately 1% boron, approximately 1.5% iron, approximately 7% aluminum, and approximately 32.5% of one or more of bronze, copper, and/or other relatively soft metallic bonding agents. It will be appreciated that aluminum is also a soft metallic bonding agent which may be used.

The thermal spraying process causes the tungsten cobalt carbide matrix material particles to clump on the roughened substrate surface 102 and mechanically bond thereto. A hardened first layer 104 is thereby provided. The layer 104 is preferably approximately 0.003 inches thick. The resulting striking surface 100 has a hardness of approximately 46 to 48 on the Rockwell C scale.

Preferably, though not required by the invention, the club head is next heat treated in a vacuum at approximately 1850° F. for approximately five to ten minutes, causing the tungsten cobalt carbide matrix first layer 104 to fuse to the golf club head substrate in a metallurgical bond. The metallurgically bonded tungsten cobalt carbide matrix first (under) layer 104 has a hardness of approximately 54 to 58 on the Rockwell C scale.

If the club head is heat treated, the striking surface of the heat treated club head is preferably sandblasted, or otherwise treated (e.g., chemically treated), to roughen the surface and to remove contaminants and impurities. The same or similar process may also be performed on the club head even if it was not heat treated.

Whether or not the club head with the tungsten cobalt carbide matrix first layer is heat treated and roughened, a ceramic-metal matrix of hard composites is next thermal sprayed onto the striking surface of the club head to form a second layer 106. The ceramic-metal matrix is a blend, in preferably an approximately twenty to one ratio by atomic weight, of a ceramic matrix and the tungsten cobalt carbide matrix described above. The ceramic matrix is preferably approximately 87% by atomic weight aluminum oxide ($AlO_2$), preferably having a particulate size of approximately −53 mesh, and 13% by atomic weight titanium oxide ($TiO_2$), preferably having a particulate size of approximately −270 mesh. The thermal spraying causes the ceramic-metal matrix to form a mechanical bond to the tungsten cobalt carbide layer. The ceramic-metal matrix second layer 106 is approximately 0.003–0.007 inches thick and is harder than the tungsten cobalt carbide layer 104. The striking surface with the ceramic-metal matrix layer over the tungsten cobalt carbide layer has a hardness of approximately 60 to 63 on the Rockwell C scale if the chemical heat treated step is performed, or slightly less if the heat treating step is bypassed.

Finally, according to the preferred embodiment of the invention, any overspray of the ceramic-metal matrix layer on the club head is removed by sanding. Preferably a 400 grit silicon carbide sandpaper is used for the sanding process.

The striking surface 100 is thereby provided with a multilayer coating 108. The multilayer coating 108 is very hard and can transfer the momentum of a golfer's swing into a greater ball hitting distance. The multilayer coating 108 has very good adhesion to the substrate 102 with its mechanical bond, and an even stronger bond when provided with both mechanical and metallurgical bonding (i.e., when the tungsten cobalt carbide coating is heat treated). In addition, the nickel and/or aluminum, and/or other soft bonding agent in the tungsten cobalt carbide matrix provides a coating which will not fracture upon repeated impact with a golf ball. The coating is optimized for driver club heads, but may also be applied to other club head types.

Figure 4:
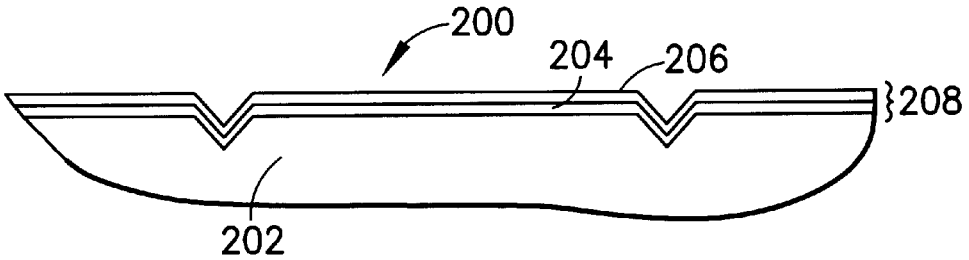
FIG. 4 is a view similar to FIG. 2 showing a multilayer coating according to a second embodiment of the invention.

Referring to FIG. 4 and according to a second embodiment of the invention, the striking surface 200 of a club head, preferably a wedge or iron club head, is treated to remove contaminants and impurities from the substrate 202 at the striking surface and to establish a roughened substrate at the striking surface. A first layer of a tungsten cobalt carbide matrix material is thermal sprayed onto the substrate to form a first layer 204, as described above. A matrix of nickel aluminum (NiAl) and bronze is then thermally sprayed onto the first layer 204 and forms a second layer 206 having a hardness of approximately 65 on the Rockwell B scale. The NiAl is preferably comprised of approximately 4% aluminum and approximately 96% nickel, by atomic weight, and the aluminum preferably has a particulate size of −170 to +325 mesh, while the nickel preferably has a particulate size of −88 to +45 microns. The bronze is preferably comprised of approximately 10% aluminum and approximately 90% copper, by atomic weight, and the aluminum preferably has a particulate size of approximately −140 to +325 mesh, while the nickel has a preferable particulate size of approximately −106 to +45 microns. Both the NiAl and bronze are available from Sulzer Metco Inc. The nickel aluminum and bronze, in matrix, are provided in preferably an approximately five to one ratio, by atomic weight. The striking surface is preferably finished by polishing using glass beading. The resulting multilayer coating 208 is optimized for the club heads of wedges and irons, but may also be used on other club head types.

Figure 5:
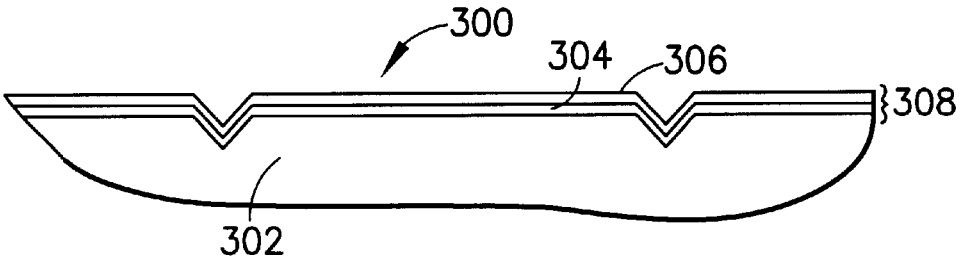
FIG. 5 is a view similar to FIG. 2 showing a multilayer coating according to a third embodiment of the invention.

Referring to FIG. 5 and according to a third embodiment of the invention, the striking surface 300 of a club head, preferably a wedge or iron club head, is treated to remove contaminants and impurities from the substrate 302 at the striking surface and to establish a roughened substrate at the striking surface. As described above with respect to the first embodiment, a tungsten cobalt carbide matrix material is thermal sprayed, onto the substrate to form a first layer 304. Next, a ceramic-metal matrix, as also described above with respect to the first embodiment, is blended in a twenty to one ratio, by atomic weight, with a matrix of nickel aluminum (NiAl) and bronze, described above with respect to the second embodiment. The ceramic-metal matrix in combination with the nickel aluminum and bronze matrix is thermally sprayed onto the striking surface of the club head to form a second layer 306 having a hardness of approximately 61 to 63 on the Rockwell C scale. Finally, the striking surface is polished.

There have been described and illustrated herein several embodiments of a multilayer coating for the striking surface of a golf club head and a method of applying the same to the substrate of the striking surface. While particular embodiments of the invention have been described, it is not intended that the invention be limited thereto, as it is intended that the invention be as broad in scope as the art will allow and that the specification be read likewise. Thus, while particular preferred ratios, by weight, of metals and ceramics have been disclosed, it will be appreciated that the disclosed ratios are only preferred, and that other ratios may be used as well. Furthermore while the preferred particulate size of the ceramics and metals have been disclosed, it will be understood that larger or smaller particulate size can be used. Also, while sandblasting is preferred for roughening the surface of the substrate for good coating adhesion, it will be recognized that other methods may be used as well, e.g., chemical treating. Moreover, while particular substrate materials have been disclosed in reference to golf club heads, it will be appreciated that other substrate materials may be used as well. Furthermore, while vacuum heat treating is disclosed at a certain preferable temperature for a certain period of time, it will be understood that other temperatures and times for heat treating can be similarly used. It will therefore be appreciated by those skilled in the art that yet other modifications could be made to the provided invention without deviating from its spirit and scope as so claimed.

What is claimed is:

1. A golf club head, comprising:

a substrate having a surface, and a multilayer coating bonded to said surface and forming a striking surface, said multilayer coating including a tungsten cobalt carbide matrix first layer bonded by a first bond to said substrate material and a substantially homogenous second layer comprised of NiAl and bronze, said second layer being harder than said first layer and forming an exposed outermost surface of said striking surface, and said second layer being bonded by a second bond to said first layer.

2. A golf club head according to claim 1, wherein:

the second layer is, by atomic weight, approximately 95% NiAl and approximately 5% bronze.

3. A golf club head according to claim 1, wherein:

said second layer is further comprised of tungsten cobalt carbide, NiAl, and bronze.

4. A method of making a golf club head, comprising:

a) coating a golf club head substrate with a tungsten cobalt carbide matrix to form a first coating layer mechanically bonded to the substrate;

b) coating the first coating layer with a ceramic metal matrix to form a second coating layer over the first coating layer, the second coating layer being mechanically bonded to the first coating layer; and c) heat treating the golf club head after said coating a golf club head substrate step, thereby forming a metallurgical bond between the first coating layer and the substrate.

5. A method according to claim 4, wherein:

said heat treating step includes heating the golf club head at approximately 1850° F. for approximately five to ten minutes.

6. A method according to claim 4, further comprising:

d) after said heat treating step, and prior to said coating the first coating layer step, roughening said first coating layer.

7. A method according to claim 4, further comprising:

d) prior to said coating a golf club head substrate step, roughening a surface of the substrate.

8. A method according to claim 4, wherein:

said coating a golf club head is performed by flame spraying or plasma spraying, and said coating the first coating layer is performed by flame spraying or plasma spraying.

9. A golf club head, comprising:

a substrate having a surface, and a multilayer coating bonded to said surface and forming a striking surface, said multilayer coating including a tungsten cobalt carbide matrix first layer bonded by a first bond to said substrate material and a substantially homogenous ceramic-metal matrix second layer harder than said first layer and forming an exposed outermost surface of said striking surface, said ceramic-metal matrix second layer comprised of a ceramic matrix blended with a tungsten cobalt carbide matrix, said second layer being bonded by a second bond to said first layer.

10. A golf club head according to claim 9, wherein:

said ceramic matrix is comprised of aluminum oxide in combination with titanium oxide.

11. A golf club head according to claim 10, wherein:

said ceramic matrix includes, by atomic weight, approximately 87% aluminum oxide and approximately 13% titanium oxide.

12. A golf club head according to claim 9, wherein:

said ceramic-metal matrix includes, by atomic weight, approximately 95% ceramic matrix and approximately 5% tungsten cobalt carbide.

13. A golf club, comprising:

a) a shaft; and b) a club head coupled to said shaft, said club head including a substrate having a surface, and a multilayer coating bonded to said surface and forming a striking surface, said multilayer coating including a tungsten cobalt carbide matrix first layer having tungsten, cobalt, carbon, and a soft bonding agent, said first layer bonded to said substrate material, and a substantially homogenous ceramic-metal matrix second layer comprised of a ceramic matrix blended with a tungsten cobalt carbide matrix, said second layer being harder than said first layer and forming an outermost surface of said striking surface, said second layer being bonded to said first layer.

14. A golf club according to claim 13, wherein:

said tungsten cobalt carbide matrix first layer comprises, by atomic weight, approximately 38% tungsten, approximately 12% cobalt, approximately 0.5% carbon, and approximately 39.5% of said soft bonding agent, said ceramic-metal matrix includes, by atomic weight, approximately 95% ceramic matrix and approximately 5% tungsten cobalt carbide, and said ceramic matrix includes, by atomic weight, approximately 87% aluminum oxide and approximately 13% titanium oxide.

15. A golf club head according to claim 13, wherein:

said first bond between said first layer and said substrate material is a first mechanical bond and said second bond between said second layer and said first layer is a second mechanical bond.

16. A golf club head according to claim 13, wherein:

said first bond between said first layer and said substrate material is a metallurgical bond and said second bond between said second layer and said first layer is a mechanical bond.

17. A golf club head according to claim 13, wherein:

said soft bonding agent is comprised of at least one of aluminum, nickel, bronze, and copper.

18. A golf club head according to claim 17, wherein:

said tungsten cobalt carbide matrix first layer comprises by atomic weight approximately 38% tungsten, approximately 12% cobalt, approximately 0.5% carbon, and approximately 39.5% of said soft bonding agent.

19. A golf club head according to claim 13, wherein:

said second layer has a Rockwell C hardness of approximately 60 to 63.

* * * * *